US009728350B2

(12) United States Patent
Müller

(10) Patent No.: US 9,728,350 B2
(45) Date of Patent: Aug. 8, 2017

(54) ILLUMINATED KEY MODULE

(71) Applicant: ZF Friedrichshafen AG, Friedrichshafen (DE)

(72) Inventor: Karl-Heinz Müller, Auerbach (DE)

(73) Assignee: CHERRY GMBH, Auerbach/OPF (DE)

( * ) Notice: Subject to any disclaimer, the term of this patent is extended or adjusted under 35 U.S.C. 154(b) by 8 days.

(21) Appl. No.: 14/780,811

(22) PCT Filed: Feb. 28, 2014

(86) PCT No.: PCT/EP2014/053895
§ 371 (c)(1),
(2) Date: Sep. 28, 2015

(87) PCT Pub. No.: WO2014/154439
PCT Pub. Date: Oct. 2, 2014

(65) Prior Publication Data

US 2016/0055988 A1 Feb. 25, 2016

(30) Foreign Application Priority Data

Mar. 28, 2013 (DE) ..... 10 2013 205 577

(51) Int. Cl.
*H01H 9/00* (2006.01)
*H01H 13/04* (2006.01)
(Continued)

(52) U.S. Cl.
CPC ..... *H01H 13/04* (2013.01); *H01H 11/00* (2013.01); *H01H 13/023* (2013.01);
(Continued)

(58) Field of Classification Search
CPC ..... H01H 2219/062; H01H 2219/036–13/023
(Continued)

(56) References Cited

U.S. PATENT DOCUMENTS 4,772,769 A 9/1988 Shumate
5,252,798 A * 10/1993 Kamada ..... H01H 9/182 200/310
(Continued)

FOREIGN PATENT DOCUMENTS

DE 19612473 A1 10/1996
DE 19649889 C1 10/1997
(Continued)

OTHER PUBLICATIONS

International Search Report issued Oct. 6, 2014 in International Application No. PCT/EP2014/053895 (English language of pp. 3-4, 2 pages).
International Search Report and Written Opinion issued Oct. 6, 2014 in International Application No. PCT/EP2014/053895 (German language, 10 pages).
Search Report dated Sep. 12, 2013 for DE 10 2013 205 577.3 (German language, 5 pages).
(Continued)

*Primary Examiner* — Vanessa Girardi
(74) *Attorney, Agent, or Firm* — SpryIP, LLC

(57) ABSTRACT

The invention proposes a key module for a key of a keyboard. The key module includes a module base, a module cover that can be coupled with the module base and a key tappet for coupling a keycap that is translucent in at least one symbol section. The module base includes at least one through-hole between a bottom section of the key module and the module cover. The module cover includes a section that is translucent for the light from a light source. The light source is a color-changeable light source for backlighting the symbol section of the keycap. The translucent section of the module cover is aligned with the at least one through-hole when the module cover is coupled to the module base.

20 Claims, 7 Drawing Sheets

(51) Int. Cl.

| | |
|---|---|
| ***H01H 13/02*** | (2006.01) |
| ***H01H 11/00*** | (2006.01) |
| ***H01H 13/10*** | (2006.01) |
| ***H01H 13/14*** | (2006.01) |
| ***H01H 13/50*** | (2006.01) |
| ***H01H 13/83*** | (2006.01) |
| *H01H 13/86* | (2006.01) |

(52) U.S. Cl.
CPC ..... *H01H 13/10* (2013.01); *H01H 13/14* (2013.01); *H01H 13/50* (2013.01); *H01H 13/83* (2013.01); *H01H 13/86* (2013.01); *H01H 2219/036* (2013.01); *H01H 2221/056* (2013.01); *H01H 2221/07* (2013.01); *H01H 2223/038* (2013.01)

(58) Field of Classification Search
USPC ..... 200/313, 314; 362/23.03, 23.07
See application file for complete search history.

(56) References Cited

U.S. PATENT DOCUMENTS

| | | | |
|---|---|---|---|
| 7,172,303 | B2 | 2/2007 | Shipman et al. |
| 2006/0000699 | A1 | 1/2006 | Sasaki et al. |

FOREIGN PATENT DOCUMENTS

| | | | |
|---|---|---|---|
| DE | 19737908 | A1 | 3/1999 |
| DE | 20014009 | U1 | 11/2000 |
| DE | 202006014084 | U1 | 11/2006 |
| DE | 102010001653 | A1 | 8/2011 |
| EP | 0083508 | A1 | 7/1983 |
| WO | WO 2006/056459 | A1 | 6/2006 |

OTHER PUBLICATIONS

Translation of p. 5 of Search Report dated Sep. 12, 2013 for DE 10 2013 205 577.3 (2 pages).

* cited by examiner

ILLUMINATED KEY MODULE

RELATED APPLICATIONS

This application is a filing under 35 U.S.C. §371 of International Patent Application PCT/EP2014/053895, filed Feb. 28, 2014, and claims the priority of German Patent Application DE 10 2013 205 577.3, filed Mar. 28, 2013, both of which are incorporated by reference herein in their entirety.

BACKGROUND

1. Technical Field

The present invention relates to a key module for a key of a keyboard and to a method for manufacturing a key module of a key of a keyboard.

2. Background Information

Of a total number of keyboards manufactured each year, a noticeable part is required for the so-called "gaming segment". In order to be able to operate computer applications also in dark rooms, some keyboards already comprise illuminated keycaps. When playing computer games for example, next to a brightness-independent recognition of keys it is also the feel when one presses the key that plays a decisive role. In particular, when pressing the keys the player should feel sufficient resistance in order to ensure a clear separation of different input commands for complex and fast-paced games.

U.S. Pat. No. 7,172,303 B2 discloses an illuminated keyboard with a lacquered, transparent keycap whose symbols is illuminated by a light source. In this case, the symbols ablated on the surface with a laser are illuminated by a light conducting channel. The light source is located outside of a range of the keycap.

So far, multiple LEDs (light-emitting diodes) have been used to create various colors of the keyboard background illumination. To illuminate the key symbols, for example light conducting channels may be required. For example it is not always ensured that the key symbols are evenly backlit. Pressure-sensitive rubber keyboards can also be used.

Against this background, the present invention provides an improved key module for a key of a keyboard and an improved method for manufacturing a key module for a key of a keyboard according to the independent claims. Advantageous embodiments result from the dependent claims and the following description.

BRIEF SUMMARY OF THE INVENTION

The embodiments of the present invention provide in particular an advantageous key module for a backlit key of a keyboard. This may in particular be a key module with an aperture in the module base for receiving a light source, such as an RGB light emitting diode, and a special module cover designed for light spread. In other words, the module base and/or the module cover of the key module have a section for receiving the light source and/or a section for directing the light radiated by the light source.

According to the embodiments of the present invention, a uniform backlighting of the key symbols can be advantageously achieved. Here, an application of an existing module model with minor modifications is possible. Thus, small changes to parts of the key module or no changes or only minor changes in the manufacturing of a module can achieve an even, clean backlighting of the key symbols, for example, without the use of additional components, in particular an additional light conductor or light conducting channel. Thus, a standard module assembly, in particular a standard MX module assembly, for example, a printed circuit board assembly or frame assembly can be carried out. Only one light source per key module is required. Thus, for example, there is no additional burden for production equipment or production machines.

In a particularly advantageous embodiment, a key module for a key of a keyboard is provided, where the key module comprises a module base and a module cover that can be coupled with the module base and a key tappet for coupling a keycap which is translucent at least in the symbol section, characterized in that the module base comprises at least one through-hole between a bottom section of the key module and the module cover, and that the module cover comprises a translucent section for the light from a light source, in particular a color-changeable light source, for backlighting the symbol section of the keycap, which, when the module cover is coupled to the module base, is aligned with the at least one through-hole. Preferably, the translucent section and the through-hole extend along a straight line, more preferably along a direction parallel to a longitudinal axis of extension of the key tappet. Under "aligned" in this case for the purposes of the present invention we understand such an arrangement in which light coming from a light source, in particular the color-changeable light source, can radiate from the direction of the through-hole to and through the translucent section for backlighting the symbol section of the keycap.

A keyboard can comprise at least one key, wherein one key module is provided for each key. A key can comprise the key module or can be formed by the key module. The key module can be for example a so-called MX module or the like. By using or installing the key module in a keyboard, backlighting of the keys of the keyboard can be realized. The module base and the module cover of the key module in their mutually coupled state can represent a base body of the key module. In an assembled state of the key module, the key tappet can be partially movably disposed in a base body of the key module formed by the module base and the module cover along a longitudinal axis of extension of the key tappet. In such case the key tappet can extend throughout an opening in the module cover. Thus, depending on its movement or actuation, the key tappet can have a section variably protruding from the module cover. The bottom section of the key module can comprise a section of the module base. At its bottom section, the key module can be mounted onto a support element. In an assembled state of the key module, the module cover can be arranged between the module base and a key cap coupled to the key tappet.

According to one embodiment, the key module can comprise the light source, preferably a color-changeable light source. Here, the light source may be disposed adjacent to the bottom section of the key module or to the module cover. The light source may be a light emitting diode (LED, Light Emitting Diode). The color-changeable light source may preferably be an RGB LED or red-green-blue light-emitting diode. The light source can also be a surface-mounted light source or SMD light source. The light source can be configured to emit light through the translucent section of the module cover to a coupled keycap or to a mounting location of the keycap. Alternatively, the light source may be configured to emit light through the through-hole of the module base and the translucent section of the module cover to a coupled keycap or to a mounting location of the keycap. Such an embodiment offers the advantage that any color choice of the light emitted by the light source for backlighting the keycap is made possible by means of merely one light source. Also, a standard surface mount or SMD mounting of the light source, for example the RGB LED, can be used.

In particular, a longitudinal extension axis of the key tappet can be arranged spaced from a mounting location of the light source. Also, with respect to a viewing direction along the longitudinal axis of extension of the key tappet, a mounting area of the light source can be spaced from a mounting area of key tappet. Here, the longitudinal extension axis of the key tappet can pass through a center or center area of the key module.

Such an embodiment offers the advantage that the key tappet does not impair the illumination of the keycap, because the light source is arranged spaced from the key tappet. Also, the key module can comprise the keycap translucent at least in a symbol section, which is coupled to the key tappet. Here, the keycap can comprise, on a side which in the coupled state is facing the module cover, a light diffusing device for diffusing the light from the light source on at least one area of the key cap comprising the symbol section. The keycap can represent a part of the key module that is visible for an operator and is operated by depressing. Such an embodiment offers the advantage that by means of such a keycap with light diffusing means, the light from the light source can be uniformly distributed over the symbol section.

In addition, the key tappet can be designed translucent for the light from the light source. Such an embodiment offers the advantage that a uniform illumination or backlighting of the keycap can be improved, because such key tappet represents no relevant obstacle for the light from the light source.

Preferably, the module base or alternatively the module cover or alternatively the module base and the module cover can comprise a section at least partly translucent for the light from the light source. Preferably, the module base and/or the module cover comprise a translucent area in a wall section leading to the key tappet. The translucent area can be formed of a translucent material and/or by at least one passage leading to the key tappet. Preferably, only the wall sections visible from outside of the module base or the module cover are formed opaque except for the wall section of the module cover leading to the keycap is opaque, wherein the inner wall sections enclosed by these wall sections are formed translucent. The module base or the module cover may be formed from a combination of an opaque and a translucent material. Alternatively, to reduce the manufacturing cost, the module base or the module cover can be formed entirely of a transparent material, wherein the opaque sections of the module base or the module cover are provided with an opaque coating. Further alternatively, the module base or the module cover may be formed entirely of an opaque material, wherein the translucent section of the module base or the module cover is formed by the at least one passage.

According to the preferred embodiment, a homogenous illumination of the symbol section of the keycap can be achieved. In other words, a more extensive and even illumination of the keycap is achieved. Further, a light scattering to an adjacent key module or module base can be largely or almost completely avoided.

According to the present invention, the passage opening is provided to be permeable for the light from the light source and/or designed to receive at least a section of the light source. Here, the through-hole may have an opening profile which corresponds to at least a base area of the light source. Thus, the light source can at least partially protrude into the through-hole or the light from the light source can penetrate the through-hole. Such an embodiment offers the advantage that the light source may be disposed adjacent to the bottom section of the key module or to a support element for supporting the key module, which allows easy installation of the key module.

Here, the translucent section of the module cover can have a light passing aperture penetrable by the light from the light source or a light diffusion means. The light diffusion means may be formed as a diffusing screen or diffusion surface. The diffusing surface can be preferably formed lenticular or prismatic for backlighting the symbol section of the keycap. Alternatively, in a preferred manner the diffusion surface can have other forms suitable for backlighting of the symbol section such as a spherical segment surface. The light diffusing device can be arranged on the module cover which in the assembled state of the key module is facing the module base or the keycap. The module thus has, at least in the area of the light diffusion means, a material translucent or permeable or transparent for the light from the light source. Such an embodiment offers the advantage that thus the light from the light source can be evenly spread for illumination or backlighting of the keycap. In the case of irradiation opening there results a brighter illumination of the module cover in the area of the keycap opposite the irradiation opening.

According to a further embodiment, there can be provided a light conducting device for conducting the light from the light source. The light conducting device can be arranged extending from the through-hole of the module base to a light conducting aperture that is formed by the translucent section of the module cover. Here, the light conducting device can comprise a light conducting channel. On the end of the light conducting device that is facing the coupled keycap can be arranged a light diffusing device, in particular a diffusing screen or diffusing surface as described above. The light diffusing device may be provided in the vicinity of the keycap. Preferably a surface side of the light diffusing device facing the keycap can be arranged between the nearest surface side of the module cover and the keycap. The arrangement of the light diffusing device is preferably selected such that the keycap can be freely operated. Preferably, the light diffusing device can form an actuation limit stop for the keycap. In other words, a maximum actuating path of the keycap and/or the key tappet corresponds to a direct distance from a bottom of the keycap to the surface side of the light diffusion device opposite to this bottom. Alternatively or more preferably, the surface side of the light diffusing device facing the keycap and the nearest surface side of the module cover facing the keycap lie in a plane. Furthermore, alternatively the surface side of the light diffusing device can be arranged between nearest surface side of the module cover facing the keycap and the through-hole of the module base. The preferred embodiment has the advantage that the light source can be arranged in the bottom section of the key module, but a light line to the coupled keycap can be improved by the light conducting device, wherein the light conducting device can reach as close as possible to the keycap for its better illumination.

According to a further preferred embodiment, the light conducting device may be a separate component that can be attached to the key module, which is more preferably attachable in a releasable manner. For this purpose, preferably at least the light conducting device comprises attaching means for mounting the light conducting device on the key module. These fastening means can for example be conventional locking means such as locking hooks or locking pins, which are provided to cooperate with the through-hole of the module base. The locking hooks can for example be provided for locking into the through-hole of the module base or in the translucent section of the module cover or for engaging behind an edge that limits or encloses the through-hole or the translucent section. The locking pins can be configured for example as an insert pin, which preferably further has a cross-sectional thickness necessary for a press fit, wherein the cross-sectional thickness is at least equal to an opening width of the through-hole or the translucent section. More preferably, the locking pin can be formed tapered in the receiving direction of the through-hole or of the translucent section to facilitate assembly. Alternatively, the key module and the light conducting device can have corresponding locking means, whereby either the light conducting device or the key module comprise locking projections such as locking hooks and the corresponding locking recesses or locking projections for receiving the latching means. More preferably, the module cover and/or the module base can comprise corresponding locking means. By means of the separately attachable light conducting device, the keyboard can be equipped with the key module as required, whereby manufacturing costs can be reduced.

A particularly advantageous method for manufacturing a key module for a key of a keyboard has the following steps:

Providing a variant of the above-mentioned key module and a support element for supporting the key module;

Mechanically connecting a light source, in particular a color-changeable light source, to the support element in an electrically conductive manner; and Attaching the key module to the support element so that the light source is aligned with the at least one through-hole of the module base and the translucent section of the module cover.

The method can be advantageously carried out in connection with a variant of the above-described key module. By carrying out the method, a variant of the above-described key module ca be advantageously manufactured.

In one embodiment, a first version of the key module can be provided in the step of providing. Further, the light source can be arranged on the support element in the step of connecting. For example, the support element may comprise a printed circuit board. Here, in the step of connecting the light source can be arranged on the printed circuit board by means of surface attachment. The first version of key module comprises a key module for a key of a keyboard, wherein the key module has a module base, a module cover to be connected to the module base, and a key tappet for coupling a keycap that is at least in one symbol section translucent, characterized in that the module base comprises at least one through-hole between a bottom section of the key module and the module cover, and in that the module cover comprises a translucent section for the light from a light source, in particular a color-changeable light source, for backlighting the symbol section of the keycap, which translucent section coupled with the module cover to the module base is aligned with the at least one through-hole. Further, optionally, the key module can comprise the light source, in particular, the color-changeable light source, a longitudinal extension axis of the key tappet can be arranged spaced from an installation place of the light source, the key module can comprise the keycap that is translucent in at least one symbol section and is coupled to the key tappet, wherein in the coupled state of the module cover, the keycap can comprise on one side facing the module cover a light diffusing device for diffusing the light from the light source over the symbol section, the key tappet can be translucent for the light from the light source, the module base can have a through-hole, which is translucent for the light from the light source and/or is adapted to receive at least a section of the light source, and/or the translucent section of the module cover can have an aperture penetrable by the light from the light source or a light diffusion device.

According to a further embodiment, a second version of the key module can be provided in the step of providing. Further, the light source can be arranged on the support element in the step of connecting. In this case, the method may comprise a step of arranging the light conducting device for conducting the light from the light source, so that the light conducting device extends at least from the through-hole of the module base up to the light conducting opening of the module cover. The third version of the key module includes a key module for a key of a keyboard, wherein the key module comprises a module base, a module cover that can be connected with the module base, and a key tappet for connecting a keycap that is translucent at least in one symbol section, characterized in that the module base comprises at least one through-hole between a bottom section of the key module and the module cover, and in that the module cover comprises a translucent section for the light of a color-changeable light source for backlighting the symbol section of the keycap, which when the module cover is coupled to the module base is aligned with the at least one through-hole. According to the third version of the key module, the module base can have a through-opening and the translucent section of the module cover can have a light conducting opening and can further comprise a light conducting device for conducting the light from the light source, wherein said light conducting device can be arranged extending at least from the through-opening of the module base to the light conducting opening of the module.

BRIEF DESCRIPTION OF THE DRAWINGS

The invention will now be explained by way of example with reference to the accompanying drawings. The figures show.

DETAILED DESCRIPTION OF THE PREFERRED EMBODIMENTS

Figure 1A:
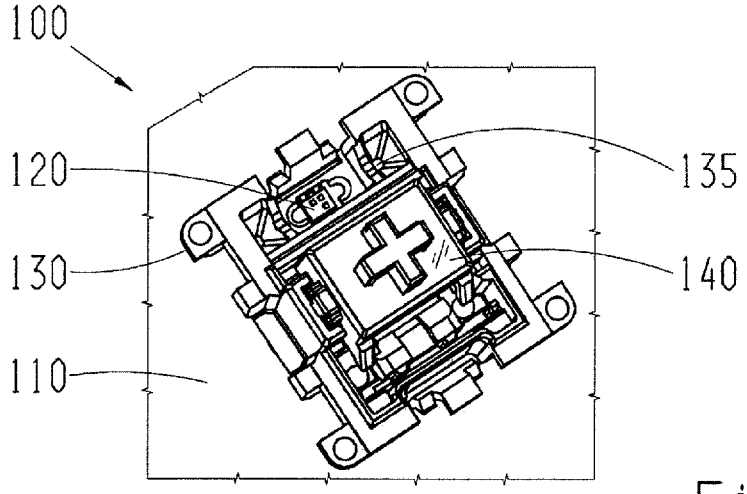
FIG. 1A shows a perspective view of a partially assembled key module on a carrier element according to exemplary embodiments of the present invention.

In the following description of preferred embodiments of the present invention, same or similar reference numerals are used for the elements shown in the various figures that have a similar function, and a repeated description of these elements is omitted.

FIG. 1A shows a perspective view of a partially assembled key module 100 on a carrier element 110 according to one embodiment of the present invention. The key module 100 is thus shown in FIG. 1A in a partly incomplete assembly state. The key module 100 is a key module for a key of a keyboard. FIG. 1A shows a light source 120, a module base 130 with a through-hole 135 and a key tappet 140 of the key module 100. The light source 120 and the module base 130 are mounted on the support element 110. The support element 110 has, for example, a printed circuit board. The key tappet 140 is mounted on the module base 130.

The light source 120 of the key module 100 comprises as an example an RGB LED (RGB=red, green, blue; LED=light-emitting diode).

The light source 120 of the key module 100 comprises, for example, an RGB LED (RGB=red, green, blue; LED=light-emitting diode). The light source 120 is designed as a color-changeable light source 120. The light source 120 is mechanically connected with the support element 110 by way of example by means of surface mounting in an electrically conductive manner.

The module base 130 of the key module 100 has the through-hole 135. The through-hole 135 is formed to accommodate the light source 120 and to allow passage of the light source 120 through the through-hole 135. The module base 130 is arranged on the support element 110. Here, a side of the module base 130 facing the carrier element 110 represents a bottom section of the key module 100. In other words, the module base 130 is mounted on the support element 110 such that the light source 120 at least partially extends through the through-hole 135. The through-hole 135 is formed in an edge section of a bottom surface of the module base 130.

The module base 130 further comprises a receiving section for the key tappet 140. The receiving section of the module base 130 is formed in a central region of the surface of the module base 130. In the plan view shown in FIG. 1A, the module base 130 has an approximately rectangular outline. A base body of the key tappet 140 in the plan view shown in FIG. 1A has also an approximately rectangular outline. The main body of the key tappet 140 is arranged approximately centrally in the module base 130. The key tappet 140 has a cross-shaped elevation which rises above a surface of the main body of the key tappet 140. The elevation can for example be formed by two intersecting bars. The elevation can be centrally located on the surface of the main body of the key tappet 140. Outer sections of the module base 130 form a circumferential rim around the main body of the key tappet 140. The through-hole 135 is arranged adjacent to the key tappet 140 in the circumferential rim of the module base 130. The through-hole 135 extends along a side wall of the main body of the key tappet. The through-hole 135 has a rectangular opening cross-section. The opening cross-section can have a length which is at least twice as long as a width of the opening cross-section. The opening cross-section can have a length corresponding to at least the length of the side wall of the key tappet 140 facing the through-hole 135. The through-hole 135 can extend over the entire length of the side wall of the key tappet 140. The through-hole 135 and the key tappet 140 can be separated by a narrow bar, which is formed by a section of the circumferential rim of the module base 130.

The key tappet 140 of the key module 100 is partially arranged in the receiving section of the module 130. The key tappet 140 stands out from the module base 130 and the support element 110. More specifically, a first end of the key tappet, for example, at least a section of said main body of the key tappet, is accommodated in the key module 100, and a second end of the key tappet 140, which is formed by at least a part of the said elevation of the key tappet 140, is designed as a connection section for connecting a keycap.

In other words, FIG. 1A shows an exemplary so-called MX module as the key module 100 with an RGB LED cradle in the form of the through-hole 135. FIG. 1A illustrates the key module 100 with the through-hole 135 as a receiving device for the light source 120 or the RGB LED. The through-hole 135 can be realized as a breakthrough in module base 130 or the bottom section, into which dips the light source. Thus, for example, a standard MX module bottom with a small modification can be used. Such an arrangement or positioning of the light source makes a translucent design of the key tappet 140 dispensable because the symbols on a coupled keycap can be directly illuminated by the light from the light source 120. Optionally, it is possible to make also the key tappet 140 of a translucent or transparent material to increase the backlit surface on a keycap. In the side wall of the module base 130 that faces the key tappet 140 can further be provided another through-hole 150 for passing the light emitted from the light source 120. Thus, a more uniform illumination of a keycap can be achieved.

According to an embodiment not shown, the module base 130 can comprise one or more additional through-holes for one or more additional light sources. For example, another through-hole can be arranged on the side of the key tappet 140 opposite to the through-hole 135.

Figure 1B:
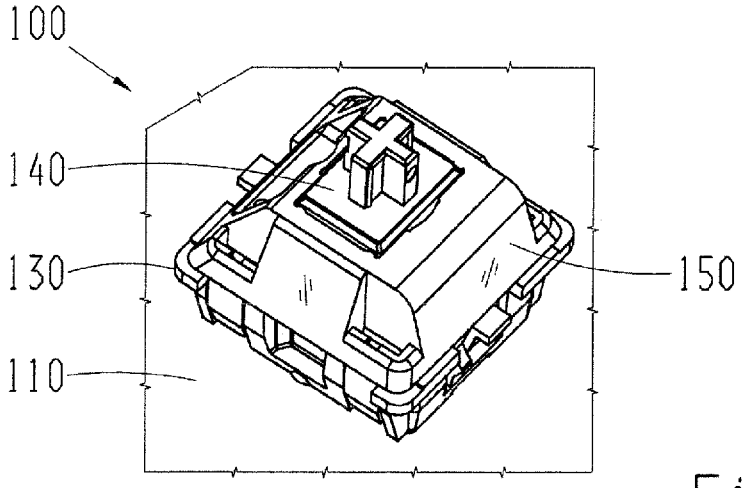
FIG. 1B shows the key module of FIG. 1A from a perspective rotated relative to FIG. 1A in a more advanced assembly state.

FIG. 1B shows the key module 100 of FIG. 1A from a perspective rotated relative to FIG. 1A, wherein compared to FIG. 1A, the key module 100 is illustrated in a more advanced assembly state.

The representation in FIG. 1B corresponds to the representation of FIG. 1A apart from the changed perspective except that the key module 100 is additionally shown a module cover 150 and due to the representation, the light source and the through-hole are hidden from view. Thus, FIG. 1B shows the key module 100, the support element 110, the module base 130, the key tappet 140 and the module cover 150.

The module cover 150 is coupled to the module base 130. The key tappet 140 extends through an opening in the module cover 150. Here the second end, i.e. the coupling section, of the key tappet 140 protrudes from the module cover 150. The embodiment of the module 150 according to the present invention shown here is formed of a translucent or transparent material.

In other words, FIG. 1B shows an additional translucent module cover 150 or MX cover of the key module 100. The module cover 150 is made of transparent material and serves as a light conductor between the light source and the attachable keycap. The module cover 150 may have a light diffusing device not explicitly shown in FIG. 1B. A targeted design of the light diffusing device or light diffusing surface can additionally increase the illuminated surface of the keycap.

Figure 1C:
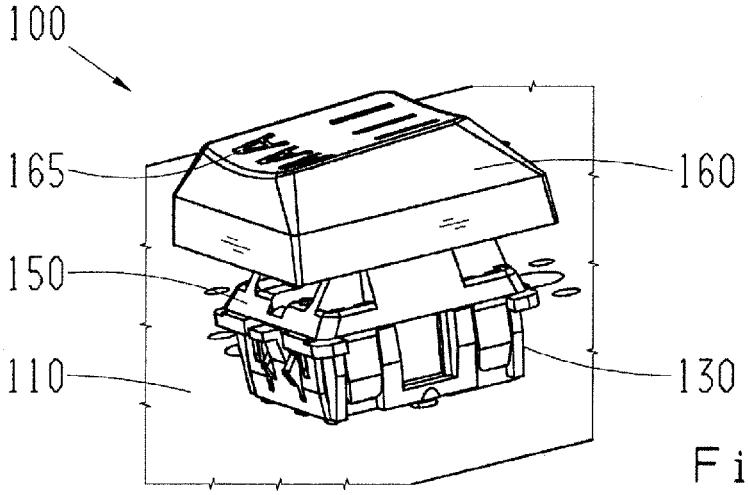
FIG. 1C shows the key module of FIG. 1B from a perspective twisted relative to FIG. 1B in a different assembly state compared to FIG. 1B.

FIG. 1C shows the key module 100 of FIG. 1B from a perspective twisted relative to FIG. 1B, said key module 100 being shown in a different assembly state compared to FIG. 1B. The illustration in FIG. 1C corresponds to the representation of FIG. 1B apart from the changed perspective with the exception that of the key module 100 is in addition shown a keycap 160 with a symbol section 165, and the key module 100 is shown in a state separated from the support element 110 and, due to the type of representation, the light source and the through-hole are hidden from view. Thus, in FIG. 1C are shown the key module 100, the support element 110, the module base 130, the module cover 150, the keycap 160 and the symbol section 165. The keycap 160 is coupled to the key tappet even though this is not shown in FIG. 1C due to the type of representation. Specifically, the keycap 160 is coupled to the coupling section, i.e., the second end of the key tappet. The keycap 160 spans here, for example, the module cover 150 and the module base 130. The keycap 160 comprises the symbol section 165. According to the embodiment of the present invention described herein, the symbol section 165 includes by way of example "AAA" as the key symbols or characters. The keycap 160 is embodied here in the symbol section 165 translucent. Upon illuminating the keycap 160 by the light source, the symbol section 165 is backlit. The keycap 160 thus becomes a visible part of the key module 100 and can be operated by a user. When a user operates the key module 100, the keycap 160 together with the key tappet are movable relative to the module base 130, the module cover 150 and the light source as well as relative to the support element 110.

In other words, FIG. 1C shows a complete key module 100. The keycap 160 is exemplary designed as a transparent keycap being opaque because encased with a lacquer layer. In the symbol section 165, the lacquer layer is removed, for example by means of a laser. The symbols contained in the symbol section 150 are backlit in different colors by the light source in the form of an RGB LED. A selection of the light color emitted by means of the light source for lighting can be selected by the user, individually, as often as needed and adjusted at any time, for example by software or hardware.

Figure 1D:
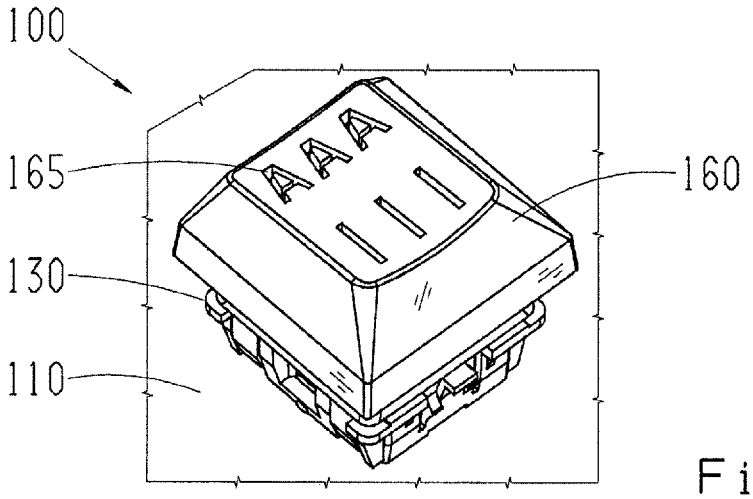
FIG. 1D shows the key module of FIG. 1C from a perspective changed relative to FIG. 1C in a different assembly state compared to FIG. 1C.

FIG. 1D shows the key module 100 of FIG. 1C from a perspective changed relative to FIG. 1C, whereby the key module 100 is shown in a different assembly state compared to FIG. 1C. Apart from the changed perspective, the representation in FIG. 1D corresponds to the representation in FIG. 1C with the exception that the key module 100 is shown as attached to the support element 110 and, due to the type of representation, the key tappet, the module cover, the light source and the through-hole are hidden from view. Thus, FIG. 1D shows the key module 100, the support element 110, the module base 130, the keycap 160 and the symbol section 165.

Referring to FIGS. 1A to 1D it is noted that, in the manufacturing of the key module 100, the light source 120, i.e., RGB SMD LED is soldered to the carrier element 110, specifically to the printed circuit board. The equipping of the support element 110 with the key module 100 may be done with standardized components in a standard process. With four terminals called pins, an RGB LED as the light source 120 has two extra ports over a standard LED.

Figure 2:
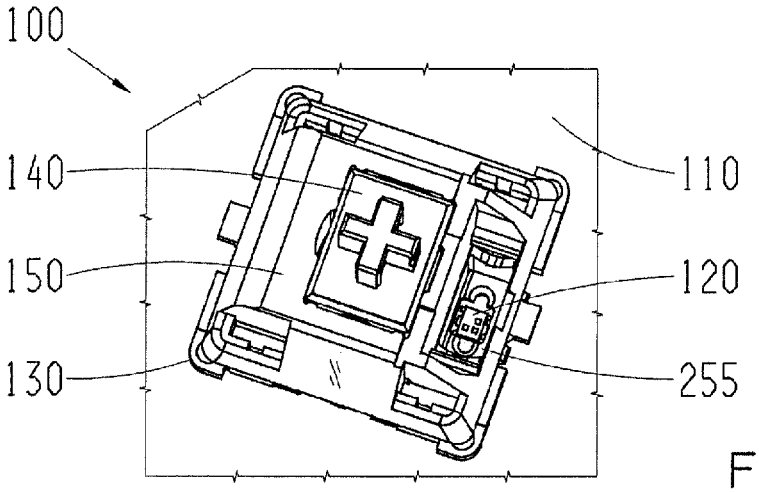
FIG. 2 shows a plan view of a key module for a key of a keyboard according to a further embodiment of the present invention.

FIG. 2 shows a plan view of a key module 100 for a key of a keyboard according to a further embodiment of the present invention. Shown are the key module 100, a support element 110, a light source 120, a module base 130, a key tappet 140, a module cover 150 and a translucent section 255 of the module cover 150. The key module 100 in FIG. 2 corresponds for example to the key module shown in FIGS. 1A to 1D, wherein an assembly state of the key module 100 corresponds to an assembly state as shown in FIG. 1B, with the exception that the module cover 150 in FIG. 2 comprises the translucent section 255 and, apart from the translucent section 255, is formed for example of an opaque material.

According to the embodiment of the present invention shown in FIG. 2, the translucent section 255 is formed as a light radiation opening. Here, the translucent section 255 is aligned with the light source 120 and a through-hole of the module base 130, which is not shown in the illustration in FIG. 2 due to the type of representation. In other words, the module cover 150 is an open cover made of standard material, i.e., the original material of an MX module. Thus, the light emitted by means of the light source 120 can pass through the opening of the module base 130 and the translucent section 255 of the module cover 150 to cause a backlighting of the keycap of the key module 100.

Figure 3:
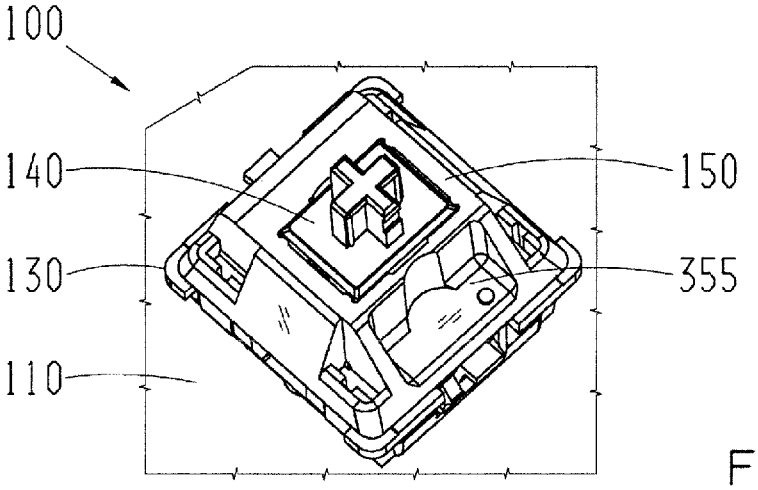
FIG. 3 shows a perspective view of a key module for a key of a keyboard according to another embodiment of the present invention.

FIG. 3 shows a perspective view of a key module 100 for a key of a keyboard according to another embodiment of the present invention. Shown are the key module 100, a support element 110, a module base 130, a key tappet 140, a module cover 150 and a translucent section 355 of the module cover 150. The key module 100 in FIG. 3 in this case corresponds to the key module shown in FIG. 2 with the exception that in FIG. 3, the translucent section 355 of the module cover 150 comprises a light diffusing device. Here, the translucent section 355 and the light diffusing device are in particular formed as a diffusing surface or diffusing screen. The diffusing surface or the diffusing screen are arranged either on a surface of the module cover 150 facing the light source or the module base 130 or on a surface of the module cover 150 facing the attachable keycap in the translucent section 355. The diffusing surface can be configured lenticular or prismatic in order to provide a needs-based illumination of the keycap. Other configurations of the light diffusing surface suitable for predetermined diffusing of light, such as a spherical segment surface, are also conceivable in order to provide a corresponding predetermined background illumination of the keycap. In general, the diffusing surface can be flat or curved in direction toward the keycap or from it. This allows to achieve different intensities and distributions of illumination for backlighting the symbol section of the keycap.

Figure 4:
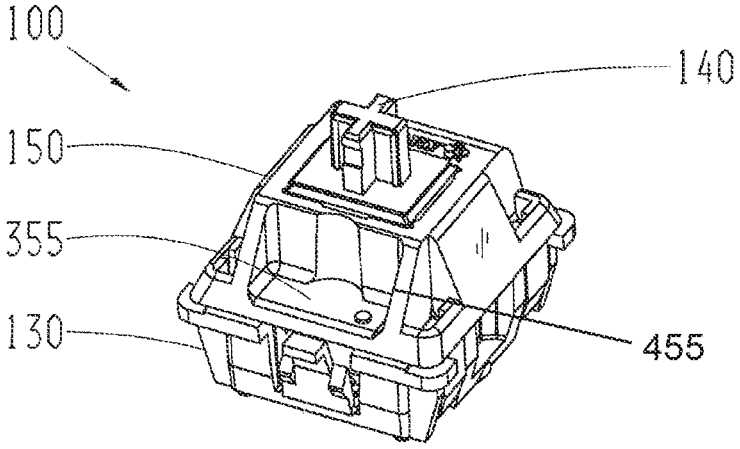
FIG. 4 shows a perspective view of the key module for a key of a keyboard according to another embodiment of the present invention.

FIG. 4 shows a perspective view of the key module 100 for a key of a keyboard according to another embodiment of the present invention. Shown are the key module 100, a module base 130, a key tappet 140, a module cover 150 and a translucent section 355 of the module cover 150. The key module 100 in FIG. 4 corresponds here, for example, to the key module shown in FIG. 3 with the exception that in FIG. 4 the key module 100 is shown from a changed perspective and no carrier element is shown. A light source of the key module 100 is obscured due to the type of representation. The light source, for example an RGB LED, can be arranged on a support element for the key module 100, for example, on a circuit board. The translucent section 355 of the module cover 150 comprises a light diffusing device, for example in the form of a diffusing surface or diffusing screen.

Figure 5:
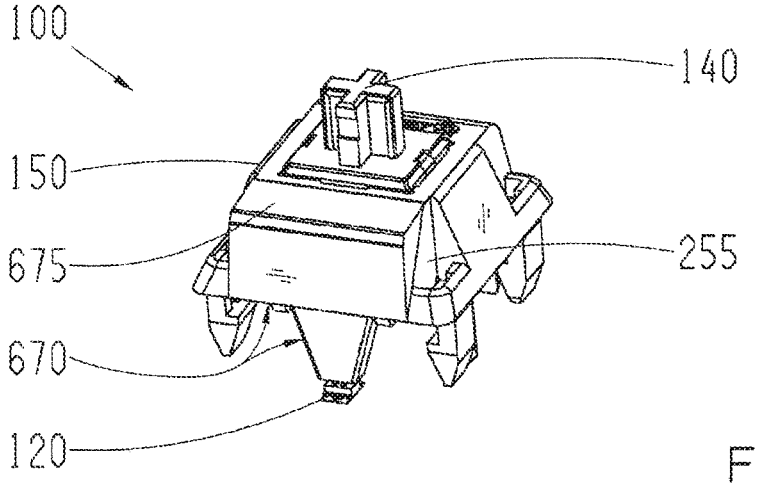
FIG. 5 shows a perspective view of the key module for a key of a keyboard according to another embodiment of the present invention.

FIG. 5 shows a perspective view of the key module 100 for a key of a keyboard according to another embodiment of the present invention. Shown are the key module 100, a light source 120, a key tappet 140, a module cover 150, a translucent section 255 of the module cover 150, a light conductor 670 and a diffusing screen 675. The key module 100 in FIG. 5 corresponds, for example, to the key module shown in FIG. 2 with the exception that in FIG. 5, the key module 100 is shown from a changed perspective, no support element and no module base are shown and the key module 100 further comprises the light conductor 670 and the diffusing screen 675.

The light source 120 is, for example, an RGB light source. The light source 120 is arranged in the area of the bottom section of the key module 100. The light conductor 670 is received in the translucent section 255 of the module cover 150 that is formed as a light radiation opening, and extends from the light source 120 through the translucent section 255. The light conducting device 670 is exemplary formed as a light conducting channel. Here, a first end of the light conductor 670 is arranged adjacent to the light source 120. A second end of the light conductor 670 is arranged on a side of the module cover 150 that faces away from the light source 120. The diffusing screen 675 is attached to the second end of the light conductor 670. A module base of the key module 100 in FIG. 5 is either hidden from view or omitted by design.

In other words, the key module 100 or MX module comprises the light conductor 670 or the light conducting channel covered with the diffusing screen 675. The light conductor 670 is thus a light conducting channel integrated in the key module 100. Alternatively, the light conductor 670 can be provided in an embodiment not shown as a separate component, which can be removably attached to the key module 100. Here, the light conductor 670 or the light conductor 670 together with key module 100, in particular the module base 130 and/or the module cover 150 can be formed with latching means for a releasable holding of the light conductor 670 to the key module 100. The locking means can comprise conventional locking elements such as latching hooks, latching projections and latching recesses in order to allow a latching of the light conductor 670 for releasable holding of the light conductor 670 to the key module 100. Further alternatively, it is conceivable that light conductor 670 be fixed to the key module 100 by an adhesive to form a not necessarily detachable design.

Figure 6A:
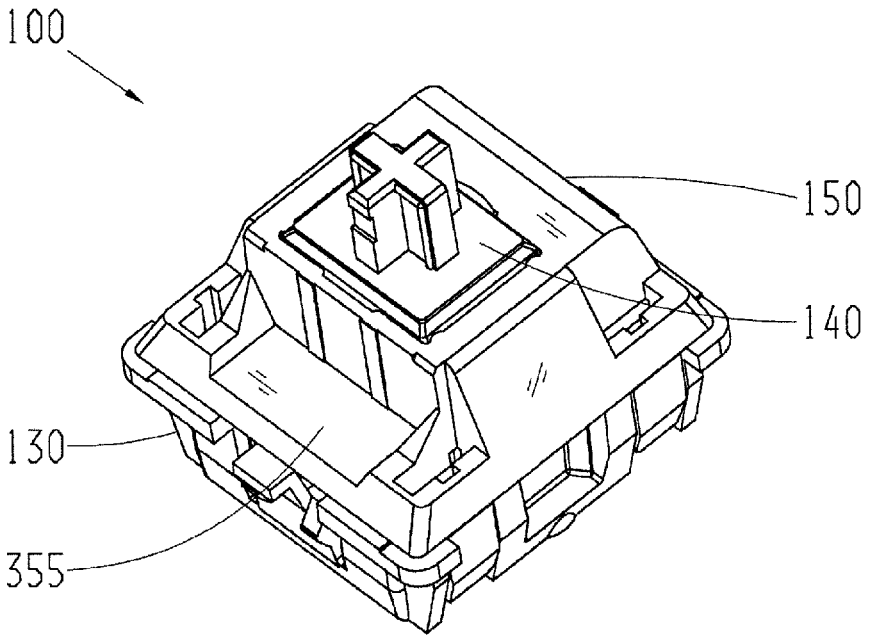
FIG. 6A shows a modified perspective view of the key module of FIG. 4.

FIG. 6A shows a modified perspective view of the key module of FIG. 4. The key module 100 shown in FIG. 6A corresponds to the key module shown in FIG. 4. Shown are the key module 100, the module base 130, the key tappet 140, the module cover 150 and the translucent section 355 of the module cover 150 containing a light diffusing device.

Figure 6B:
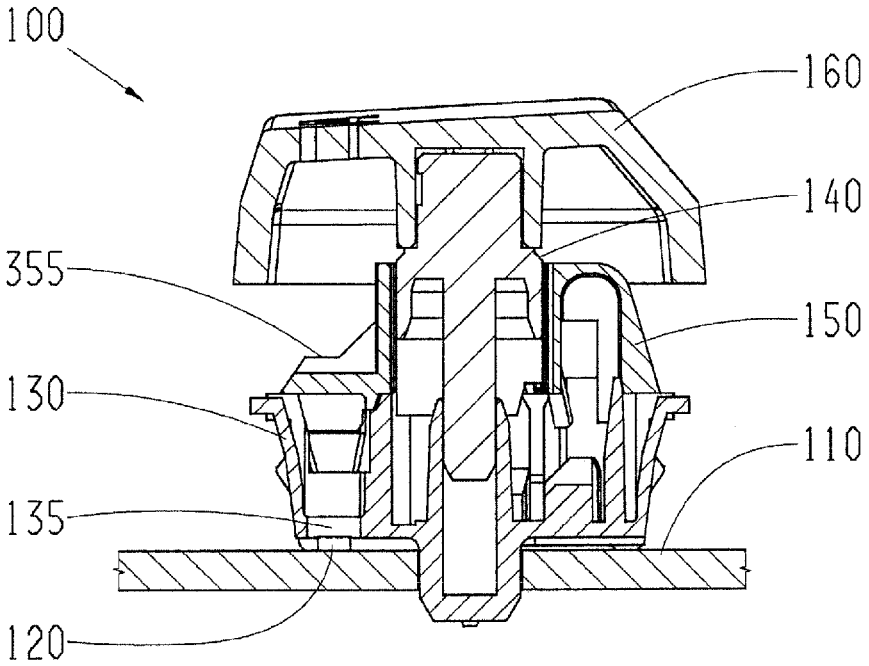
FIG. 6B shows a sectional view of the key module of FIG. 6A.

FIG. 6B shows a sectional view of the key module of FIG. 6A. Shown are a key module 100, a support element 110, a light source 120, a module base 130, a through-hole 135, a key tappet 140, a module cover 150, a keycap 160 and a translucent section 355 of the module cover 150. The key module 100 illustrated in FIG. 6B corresponds to the key module shown in FIG. 6A with the exception that in FIG. 6B in addition the support element 110 is provided, the key module 100 in addition comprises the keycap coupled with the key tappet 140, and due to the type of representation in addition the light source 120 and the through-hole 135 are shown. To get the sectional view in FIG. 6B, the key module from FIG. 6A is cut along a longitudinal axis of extension of the key tappet.

The light source 120 is arranged on the support element 110. The support element 110 is, for example, a printed circuit board. The module base 130 is attached to the support element 110. The light source 120, the through-hole 135 of the module base 130 and the translucent section 355 of the module cover 150 are aligned along a straight line. The light emitted by the light source 120 can pass the through-hole 135 and the translucent section 355 and backlight the keycap 160. The module cover 150 can be configured as a transparent or translucent module cover 150, where the translucent section 355 comprises a light diffusing device or a light diffusing surface which is spaced from the keycap 160.

Figure 7:
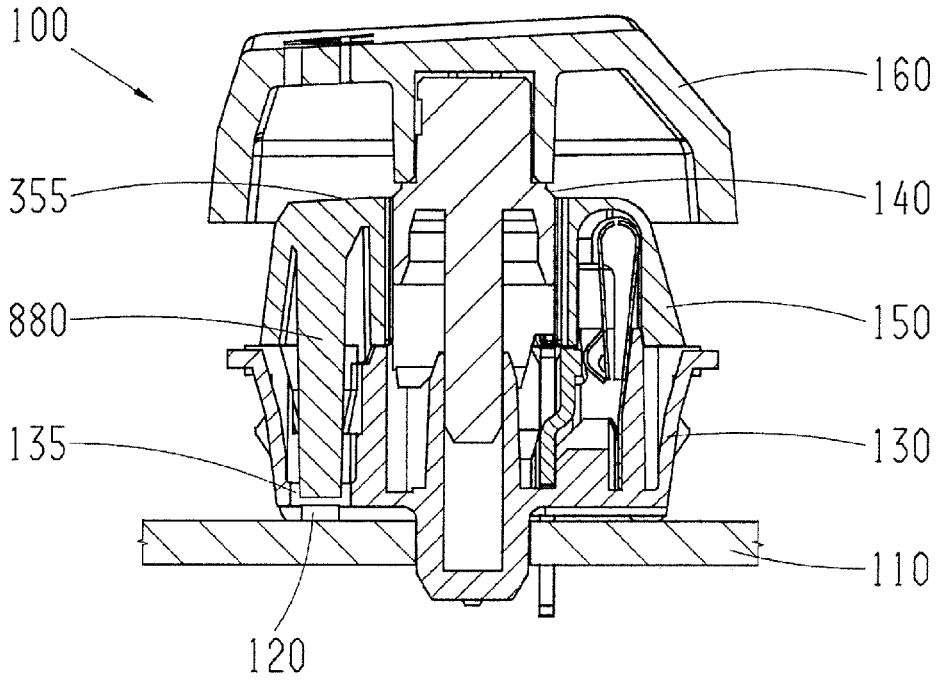
FIG. 7 shows a sectional view of a key module for a key of a keyboard according to a further embodiment of the present invention.

FIG. 7 shows a sectional view of a key module 100 for a key of a keyboard according to a further embodiment of the present invention. Shown are a key module 100, a support element 110, a light source 120, a module base 130, a through-hole 135, a key tappet 140, a module cover 150, a keycap 160, a translucent section 355 of the module cover 150 and a light conductor 880. The key module 100 illustrated in FIG. 7 corresponds to the key module shown in FIG. 6B with the exception that in FIG. 7 in addition the light conductor 880 is provided and the translucent section 355 has a spacing with respect to the keycaps 160 which is less than that in FIG. 6B. The light conductor 880 extends from the light source 120 through the through-hole 135 up to the translucent section 355. The light conductor 880 is an integrated light conductor. The translucent section 355 has a light diffusing device or a light diffusing surface.

Figure 8:
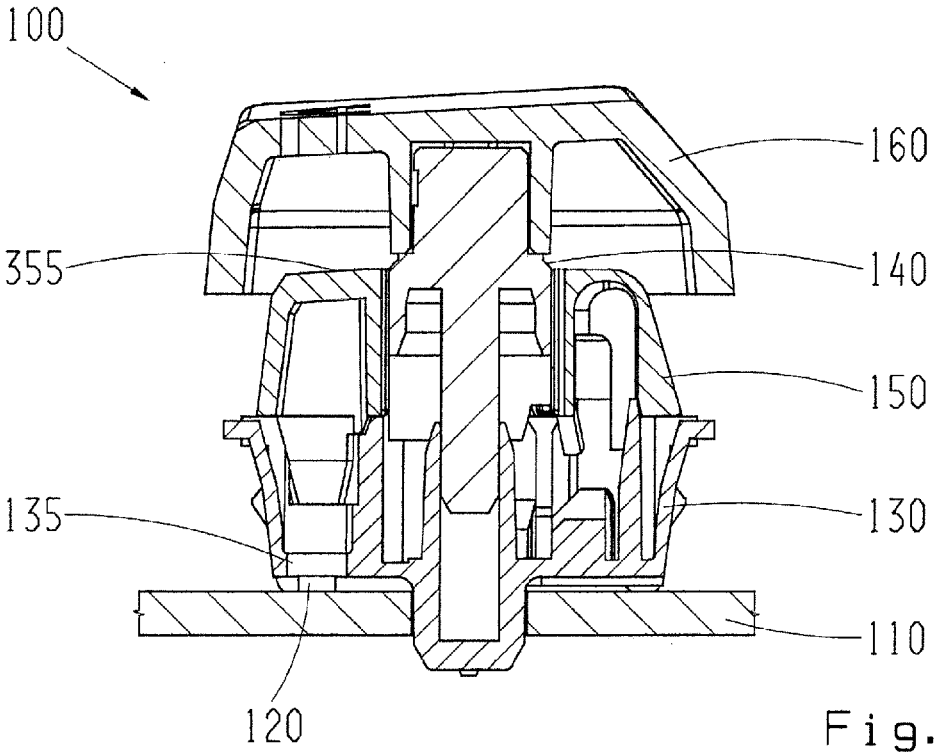
FIG. 8 shows a sectional view of the key module for a key of a keyboard according to a further embodiment of the present invention.

FIG. 8 shows a sectional view of the key module 100 for a key of a keyboard according to a further embodiment of the present invention. Shown are a key module 100, a support element 110, a light source 120, a module base 130, a through-hole 135, a key tappet 140, a module cover 150, a keycap 160 and a translucent section 355 of the module cover 150. The key module 100 illustrated in FIG. 8 corresponds to the key module shown in FIG. 7B with the exception that in FIG. 8 the translucent section 355 has a spacing with respect to the keycap 160, which is less than that in FIG. 6B.

Figure 9A:
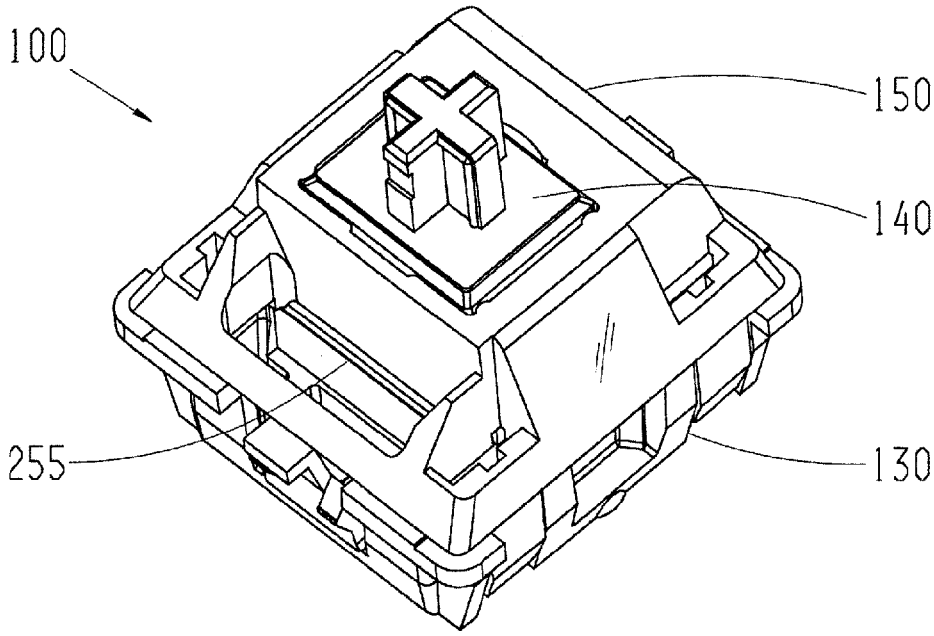
FIG. 9A shows a perspective view of the key module of FIG. 2.
Figure 9B:
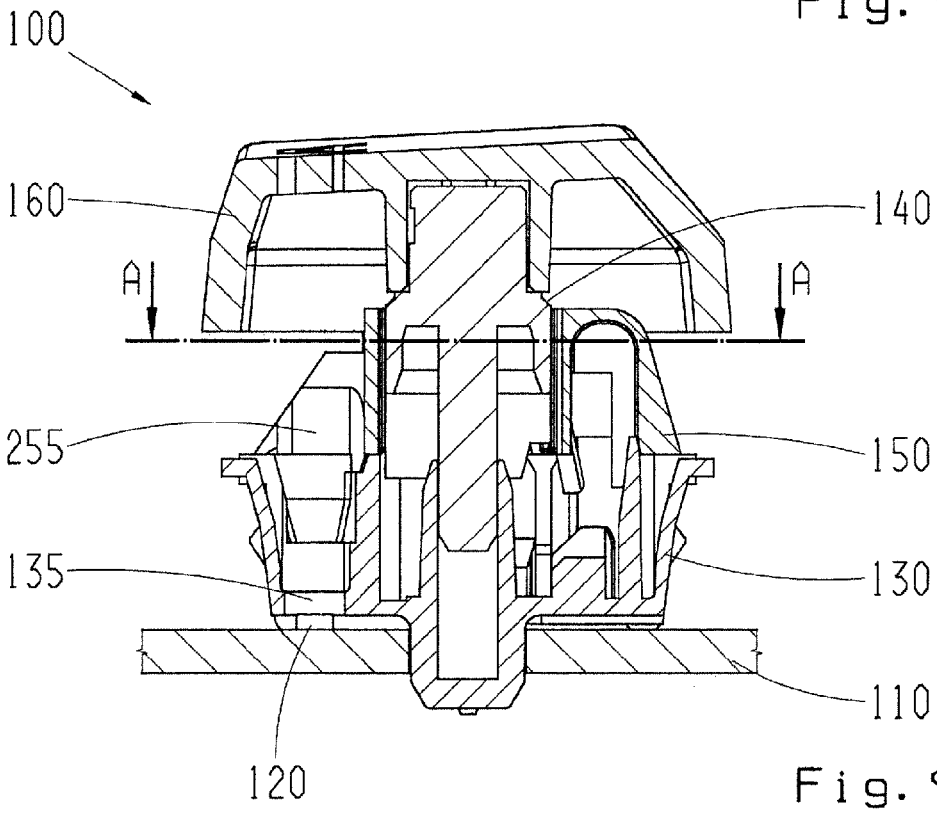
FIG. 9B shows a sectional view of the key module of FIG. 9A.

FIG. 9A shows a perspective view of the key module of FIG. 2. The key module 100 shown in FIG. 9A corresponds, for example, to the key module shown in FIG. 2. Shown are the key module 100, the module base 130, the key tappet 140, the module cover 150 and a translucent section 255 of the module cover 150 comprising a light passing aperture, FIG. 9B shows a sectional view of the key module of FIG. 9A. Shown are a key module 100, a support element 110, a light source 120, a module base 130, a through-hole 135, a key tappet 140, a module cover 150, a keycap 160 and a translucent section 255 of the module cover 150. Further, a cutting line A-A is shown.

The key module 100 illustrated in FIG. 9B corresponds to key module shown in 9A with the exception that in FIG. 9B in addition the support element 110 is provided, the key module 100 in addition comprises the keycap connected to the key tappet 140, and due to the type of representation, in addition the light source 120 and the through-hole 135 are shown. To get the sectional view in FIG. 9B, the key module of FIG. 9A is cut along a longitudinal axis of extension of the key tappet 140.

The light source 120 is arranged on the support element 110. The support element 110 is, for example, a printed circuit board. The module base 130 is attached to the support element 110. The light source 120, the through-hole 135 of the module base 130 and the translucent section 255 of the module cover 150 are aligned along a straight line. The light emitted by the light source 120 can pass the through-hole 135 and the translucent section 255 and backlight the keycap 160. The module cover 150 can be configured as a transparent or translucent cover module 150, where the translucent section 255 has a light passing aperture.

Figure 9C:
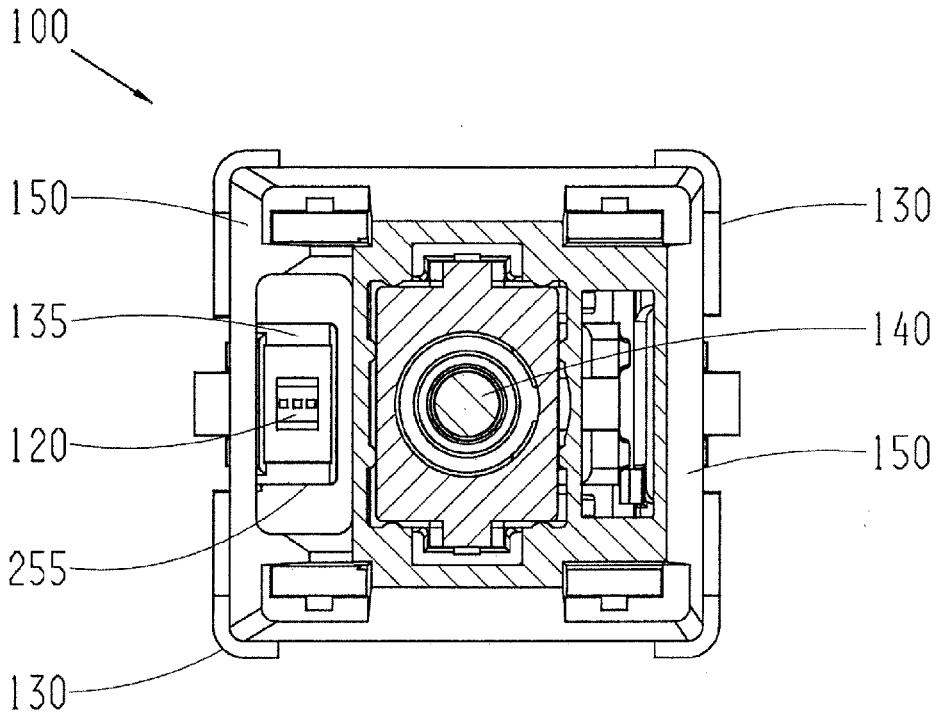
FIG. 9C shows a sectional view of the key module of FIG. 9B along the section line AA of FIG. 9B.

FIG. 9C shows a sectional view of the key module of FIG. 10B along the section line AA of FIG. 9B. Here, the support element is omitted from the illustration. Shown are the key module 100, the light source 120, the module base 130, the through-hole 135, the key tappet 140, the module cover 150, and the translucent section 255 of the module cover 150.

Figure 10:
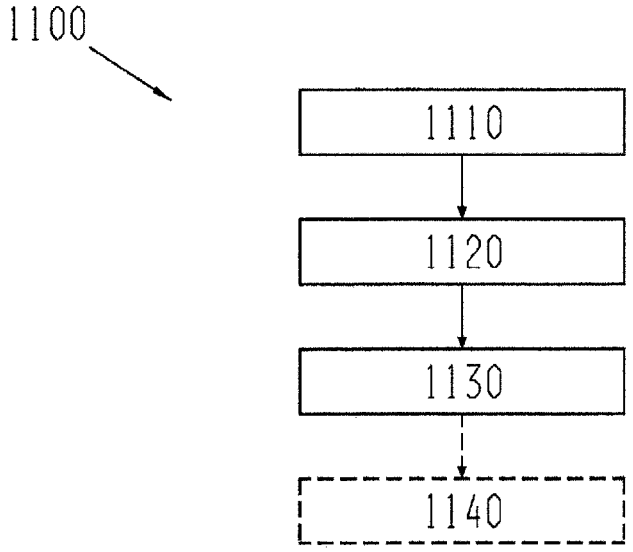
FIG. 10 shows a flow diagram of a method for manufacturing a key module for a key of a keyboard according to an embodiment of the present invention.

FIG. 10 shows a flow diagram of a method 1100 for manufacturing a key module for a key of a keyboard according to an embodiment of the present invention. The method 1100 can be advantageously carried out in conjunction with a key module as one of the key modules of one of the FIGS. 1A to 9C. By carrying out the method in 1100, a key module such as one of the key modules of the FIGS. 1A to 9C can be advantageously made.

The method 1100 includes a step 1110 of providing a key module and a support element for supporting the key module. The key module is one of the key modules of FIGS. 1A to 10C. The method 1100 also includes a step 1120 of mechanically connecting a color-changeable light source to the carrier element in an electrically conductive way. Furthermore, the method 1100 includes a step 1130 of attaching the key module to the support element, so that the light source is aligned with the at least one through-hole of the module base and the translucent section of the module cover.

According to a first embodiment of the method 1100, in step 1110 of providing, a key module such as one of the key modules from one of the FIGS. 1A to 4, 6A, 6B and 8 to 9C can be provided. Here, in step 1120 of connecting, the light source can be arranged on a support element of the key module.

According to a second embodiment of the method 1100, in the step of providing 1100, a key module such as one of the key modules from one of the FIGS. 5 and 7 can be provided. Here, in the step of connecting 1120, the light source can be arranged on a support element of the key module. Furthermore, the method in this second embodiment can include a step of arranging a light conductor for conducting the light from the light source so that the light conductor extends at least from the through-hole of the module base to the light conducting aperture of the module cover.

The embodiments described and shown in the figures are chosen only by way of example. Different embodiments may be combined entirely or in respect of individual features. Also, an embodiment can be supplemented by features of another embodiment. Steps of the described methods can be carried out repeatedly.

| Reference Numerals | |
|---|---|
| 100 | Key module |
| 110 | Support element |
| 120 | Light source |
| 130 | Module base |
| 135 | Through-hole |
| 140 | Key tappet |
| 150 | Module cover |
| 160 | Keycap or key button |
| 165 | Symbol section |
| 255 | Translucent section or light passing aperture |
| 355 | Translucent section or light diffusing device |
| 425 | Connection of the light source |
| 455 | Translucent section or receiving recess |
| 670 | Light conducting device |
| 675 | Diffusing screen |
| 880 | Light conductor |
| 1100 | Method for manufacturing |
| 1110 | Step of providing |
| 1120 | Step of connecting |
| 1130 | Step of placing |
| 1140 | Step of arranging (optional) |

What is claimed is:

1. A key module for a key of a keyboard comprising:

a module base;

a module cover connected to the module base;

wherein the module base comprises at least one through-hole between a bottom section of the key module and the module cover;

wherein the module cover is translucent and/or transparent for light from a light source;

wherein the translucent module cover is aligned with the at least one through-hole when the module cover is coupled with the module base; and a key tappet for coupling a keycap that is translucent in at least a symbol section.

2. The key module according to claim 1, wherein the module cover comprises a light passing aperture penetrable by the light from the light source or a light diffusion device.

3. The key module according to claim 2, wherein the module base further comprises a light conducting device for conducting the light from the light source that is arranged so the light conducting device extends at least from the through-hole of the module base up to the light passing aperture of the module cover.

4. The key module according to claim 3, wherein the light conducting device can be separately mounted on the key module.

5. The key module according to claim 1, wherein the light source is arranged adjacent to the bottom section of the key module or on the module cover.

6. The key module according to claim 1, wherein a longitudinal axis of extension of the key tappet is arranged spaced from a mounting location of the light source.

7. The key module according to claim 1, wherein the keycap comprises a top side, a bottom side, and a light diffusing device for diffusing the light from the light source over the symbol section wherein the bottom side faces the module cover when the keycap is coupled with the key tappet.

8. The key module according to claim 1, wherein the key tappet is translucent for the light from the light source and the module base comprises at least one translucent section leading to the key tappet for the light from the light source.

9. The key module according to claim 1, wherein the through-hole of the module base is permeable for the light from the light source and/or is adapted to receive at least a section of the light source.

10. A method for manufacturing a key module for a key of a keyboard, said method comprising:

presenting a key module comprising a module base, a module cover connected the module base, and a key tappet for coupling a keycap that is translucent in at least a symbol section;

wherein the module base comprises at least one through-hole between a bottom section of the key module and the module cover;

wherein the module cover is translucent and/or transparent for light from a light source;

presenting a support element for supporting the key module;

mechanically connecting a light source to the support element, wherein the light source is a color-changeable light source connected to the support element in an electrically conductive manner; and attaching the key module to the support element so that the light source is aligned with the at least one through-hole of the module base and the module cover.

11. The method according to claim 10, wherein the module cover comprises a light passing aperture penetrable by the light from the light source or a light diffusion device.

12. The method according to claim 11, wherein the module base further comprises a light conducting device for conducting the light from the light source that is arranged so the light conducting device extends at least from the through-hole of the module base up to the light passing aperture of the module cover.

13. The method according to claim 12, further comprising arranging of the light conducting device for conducting the light from the light source, so that the light conducting device extends at least from the through-hole of the base module to the light passing aperture of the module cover.

14. The method according to claim 10, the module cover is aligned with the at least one through-hole when the module cover is coupled with the module base.

15. The method according to claim 10, wherein the light source is a color-changeable light source for backlighting the symbol section of the keycap.

16. The method according to the claim 10, wherein the light source is arranged adjacent to the bottom section of the key module or on the module cover.

17. The method according to the claim 10, wherein a longitudinal axis of extension of the key tappet is arranged spaced from a mounting location of the light source.

18. The method according to the claim 10, wherein the keycap comprises a top side, a bottom side, and a light diffusing device for diffusing the light from the light source over the symbol section, wherein the bottom side faces the module cover when the keycap is coupled with the key tappet.

19. The method according to the claim 10, wherein the key tappet is translucent for the light from the light source and the module base comprises at least one translucent section leading to the key tappet for the light from the light source.

20. The method according to the claim 10, wherein the through-hole of the module base is permeable for the light from the light source and/or is adapted to receive at least a section of the light source.

* * * * *